US008544976B2

(12) United States Patent
Ellson

(10) Patent No.: US 8,544,976 B2
(45) Date of Patent: Oct. 1, 2013

(54) FOCUS-ACTIVATED ACOUSTIC EJECTION

(75) Inventor: Richard N. Ellson, Palo Alto, CA (US)

(73) Assignee: Labcyte Inc., Sunnyvale, CA (US)

( * ) Notice: Subject to any disclaimer, the term of this patent is extended or adjusted under 35 U.S.C. 154(b) by 353 days.

(21) Appl. No.: 13/014,087

(22) Filed: Jan. 26, 2011

(65) Prior Publication Data

US 2011/0181663 A1 Jul. 28, 2011

Related U.S. Application Data

(60) Provisional application No. 61/298,415, filed on Jan. 26, 2010.

(51) Int. Cl.
*B41J 29/38* (2006.01)

(52) U.S. Cl.
USPC ..... 347/14; 347/19; 347/75

(58) Field of Classification Search
USPC ..... 347/44–47, 51, 75–76, 7, 11, 14, 347/19
See application file for complete search history.

(56) References Cited

U.S. PATENT DOCUMENTS

| | | | | |
|---|---|---|---|---|
| 6,666,541 | B2 | 12/2003 | Ellson et al. | |
| 6,809,315 | B2 | 10/2004 | Ellson et al. | |
| 6,849,423 | B2 | 2/2005 | Mutz et al. | |
| 6,893,836 | B2 | 5/2005 | Mutz et al. | |
| 7,354,141 | B2 | 4/2008 | Ellson et al. | |
| 7,405,072 | B2 | 7/2008 | Mutz et al. | |
| 7,429,359 | B2 | 9/2008 | Reichel et al. | |
| 7,454,958 | B2 | 11/2008 | Ellson et al. | |
| 7,717,544 | B2 * | 5/2010 | Stearns et al. | 347/68 |
| 7,899,645 | B2 | 3/2011 | Qureshi et al. | |
| 7,900,505 | B2 | 3/2011 | Mutz et al. | |
| 7,988,247 | B2 | 8/2011 | Letendre et al. | |
| 2002/0064808 | A1 | 5/2002 | Mutz et al. | |
| 2002/0064809 | A1 | 5/2002 | Mutz et al. | |

FOREIGN PATENT DOCUMENTS

| | | |
|---|---|---|
| WO | WO 2006/039700 | 4/2006 |

OTHER PUBLICATIONS

PCT International Search Report and Written Opinion, PCT Application No. PCT/US2011/022576, Aug. 5, 2011, eight pages.

* cited by examiner

*Primary Examiner* — Thinh Nguyen
(74) *Attorney, Agent, or Firm* — Fenwick & West LLP

(57) ABSTRACT

To ejecting a droplet from a reservoir, the reservoir holding a fluid is moved with respect to an acoustic ejector. As the reservoir and ejector move closer together, the acoustic ejector sends one or more interrogation pulses towards the reservoir. Based on the interrogation pulses, the system determines when the movement of the reservoir has placed a free surface of the fluid in a position where a droplet can be ejected.

26 Claims, 7 Drawing Sheets

FOCUS-ACTIVATED ACOUSTIC EJECTION

CROSS-REFERENCE TO RELATED APPLICATIONS

This application claims the benefit of U.S. Provisional Application No. 61/298,415, filed Jan. 26, 2010, the content of which is incorporated by reference herein in its entirety.

TECHNICAL FIELD

This application relates to acoustics and in particular to the use of acoustics to eject droplets from a reservoir.

BACKGROUND

It is often desired to take a biological sample contained in an individual sample holder and to transfer it to one or more well plates or other objects appropriate for carrying out reactions with it (e.g., onto test strips). A single biological sample (e.g., human blood) may be divided up among a number of these downstream containers in order to be subjected to a wide variety of different tests.

Among the desiderata for the handling of biological samples are: (a) Ability to obtain a number of measurements from single blood draw. (b) Generating no waste in the sample transfer. (c) Providing a proportionate amount of fluid, particulates and cells with a transfer and overcoming challenges in achieving this at small volumes. (d) Enabling newer diagnostics that can use small samples to have consistent sample delivery. (e) Elimination of manual pipetting and associated wastes and interaction with tips, sharps, capillaries, and needles, so improving lab safety. (f) Reducing the training required for lab technicians to achieve high-quality small volume sample transfer.

Acoustic ejection is a known way of performing transfers of biological samples. In acoustic ejection, a piezoelectric transducer driven by a waveform chosen by a controller generates acoustic energy. The energy is focused by means of an acoustic lens and coupled to a reservoir containing fluid through an acoustic coupling medium, typically water. If the focused energy has a focal point inside a fluid in the reservoir and close to a free surface of that fluid, a droplet may be ejected. Droplet size and velocity may be controlled via the chosen waveform.

Current acoustic instruments rely on an active control of both the transducer and reservoir position. Typically, this involves sending a motion command to a motion controller which then initiates movement of an acoustic ejector on one or more axes. Motion in the horizontal plane aligns the transducer with the selected reservoir and motion in the vertical audits the reservoir and focuses the acoustic ejector for droplet transfer. In some contexts it is desirable to accomplish acoustic ejection by a simpler and smaller system that does not require complete control of the location of both the transducer and the reservoir.

SUMMARY

Description for ejecting a droplet from a reservoir is provided. In one embodiment of a method for ejecting a droplet from a reservoir, the reservoir holding a fluid is moved with respect to an acoustic ejector. As the reservoir and ejector move closer together, the acoustic ejector sends one or more interrogation pulses towards the reservoir. Based on the interrogation pulses, the system determines when the movement of the reservoir has placed a free surface of the fluid in a position where a droplet can be ejected. The acoustic ejector generates the ejection pulse.

In another embodiment of a method for ejecting a droplet from a reservoir, the reservoir holding a fluid is moved with respect to an acoustic ejector. As the reservoir and ejector move closer together, the acoustic ejector sends one or more interrogation pulses towards the reservoir. Based on the interrogation pulses, the system determines when the movement of the reservoir will place the free surface of the fluid in a position where a droplet can be ejected. The acoustic ejector then waits that period of time before generating the ejection pulse.

DETAILED DESCRIPTION OF PREFERRED EMBODIMENTS

In this application the following abbreviations are used: SR—surface reflection, TOF—time of flight, TB—top of the bottom of a reservoir, BB—bottom of the bottom of a reservoir.

EXAMPLE SETUP

Figure 1:
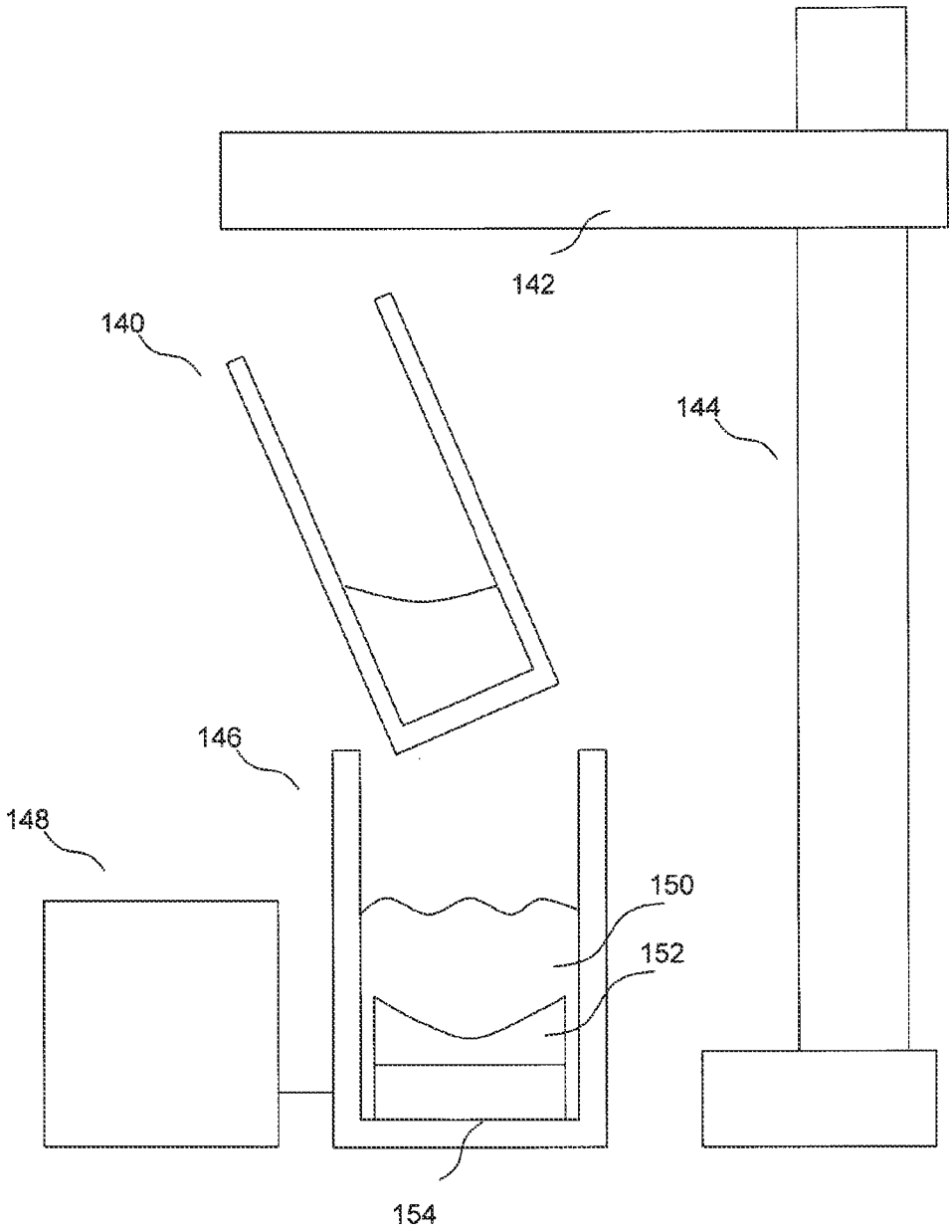
FIG. 1 schematically depicts an example setup for focus-activated acoustic ejection, according to one embodiment.

FIG. 1 schematically depicts an example setup for focus-activated acoustic ejection, according to one embodiment. In FIG. 1, an acoustic ejector is provided comprising an electronic controller 148, a piezoelectric transducer 154, and an acoustic focusing system 152. An elongated enclosed area 146, open at the top, is provided above the focusing system. A reservoir 140 is inserted into the enclosed area 146. The enclosed area 146 is in operation partly filled with a fluid 150, typically water, that can serve as an acoustic coupling medium. A target holder 144 is provided to hold a target 142 above the enclosed area. The holder 144 has a mechanism, either manually actuated or automatic, to place a particular desired well of the well plate above the enclosed area.

In one embodiment, the user places a well plate or other target 142 in an appropriate position and then inserts a suitable reservoir 140 (e.g., a sample collection tube) into the enclosed area 146 and lowers it, either manually or via an automated mechanism. As the reservoir descends, it comes into contact with the coupling fluid 150 but continues descending following this contact. The descent may be facilitated by withdrawing some of the coupling fluid 150. The controller 148 then causes the transducer 154 to send appropriate interrogation pulses into the fluid in the reservoir, determines z-axis reservoir position and fluid properties. Upon finding that the fluid surface has descended to an appropriate location for ejection, the controller causes the ejector to send an ejection pulse, causing a droplet of fluid to be ejected and placed on the target 142.

The force of gravity alone, or the force of gravity plus some removal of coupling fluid 150, may be sufficient to achieve the requisite lowering of the reservoir 140. In one embodiment, the coupling fluid 150 is open to contact with the reservoir 140 and is flowing upward rather than being withdrawn. The flow rate of the coupling fluid 150 upwards towards the reservoir 140 may be varied to control the descent rate of the reservoir 140. Once inserted, the reservoir 140 would be in a prolonged, downward movement. The speed of motion could be modulated, and optionally, the reservoir could be stopped should the need arise. The speed of motion from the time the reservoir contacts the acoustic coupling medium up to ejection could lie, for example, between 0 cm/s and 10 cm/s, or between 0.2 cm/s and 0.5 cm/s. Resistance to the downward motion of the reservoir can be provided by a number of means, including those known to those of skill in the mechanical arts such as a spring.

In one embodiment, rather than the reservoir 140 moving towards the transducer 154, instead the transducer 154 is moved to position the fluid surface in the reservoir 140 to an appropriate location for ejection. The transducer 154 may move in conjunction with the lowering of the reservoir 140, or alternatively the reservoir may be stationary and the transducer may be brought up to the appropriate position. The transducer may be moved up manually or via an automated mechanism. As above, coupling fluid 150 may also be removed to assist in the position of the fluid surface relative to the position of the transducer 154. In one embodiment, the movement of the transducer 154 is triggered by fluid pressure from the weight of the reservoir 140.

When coupling fluid 150 is removed, the rate of this removal from under the reservoir could also be modulated to adjust the relative motion of the reservoir and transducer. The coupling fluid could, for example, be driven out from under the reservoir by the weight of the reservoir assembly through a regulated flow restrictor. The regulation can respond to the need to dwell at certain heights to accomplish either the interrogation or ejection tasks. The regulation can be based on the positions of the bottom of the reservoir as determined by interrogation pulses in some type of feedback arrangement, permitting a considerable degree of control over the rate at which the reservoir descends.

In one embodiment, there is a flexible membrane between the coupling fluid and the reservoir. Where such membrane is used, it would preferably be applied to the bottom surface of reservoirs without trapping bubbles. The coupling membrane may be made, for example, of a "wet" material—either a hydrogel-like substance, similar to a contact lens, or a perforated membrane where holes are small relative to the wavelength and, optionally, oriented symmetrically about the center of the transducer so as not to distort the propagation of the acoustic beam. Optionally, the wet membrane material could also provide focusing like a contact lens. Optionally, the focusing could be from two or more separate elements, such as a lens integral to the transducer and a wet membrane lens. In addition, the wet material could be a defocusing material to increase the focal length of the acoustic beam.

It is desirable that the coupling fluid be substantially free of bubbles because they may act as scatterers for acoustic energy. While bubbles that are small (with respect to the acoustic beam) cause fewer problems than those which are on the order of the acoustic wavelength, it may be desired to take measures to eliminate bubbles. An arrangement which may be helpful in this regard is to have bubble-free water rising from around the transducer and flowing toward the reservoir.

In the arrangement of FIG. 1, the reservoir 140 is shown as being inserted from above into the enclosed area 146. Alternatively, there may be a notch or opening in the side of the walls defining enclosed area 146, through which the reservoir can initially be passed.

The reservoir 140 will commonly have a cap. The cap may be removed manually prior to insertion of the reservoir 140 into the enclosed area. Alternatively, there may be provided an automatic mechanism which removes the cap when the reservoir is in place and then replaces the cap once ejection has been carried out. The automatic mechanism may, for example, withdraw the cap by rotating it, raise it to a side, and then lower and rotate the cap back onto the reservoir. It may be helpful in order to facilitate the replacement of the cap to raise the reservoir by some means such as the addition of further coupling fluid, and to provide a mechanism (such as an elongated member pressing the reservoir against the side enclosed area 146) to temporarily hold the reservoir rigidly in place.

The target 142 here may be any system or object in which it is useful for the fluid to be placed. This may be, for example, a reservoir such as a tube or a well of a well plate. Alternatively, it may be a diagnostic receiver such as a microfluidic device, array, test strip, filter paper, or a dried blood spot (DBS) system. The target may also be used in conjunction with an analytical device (not shown) that has been loaded onto the system. An analytical device may be used for performing measurements such as mass spectrometry, high-performance liquid chromatography and/or Raman spectroscopy. Alternatively, the target may be removed and transferred, with deposited contents, to an analytical device separate from the system.

The target holder 144 may simply be a device onto which the target 142 can be clipped or otherwise temporarily attached. The target holder may alternatively comprise, for example, guides for the motion of the target in the x and/or y directions, or alternatively it may comprise a full x-y automated motion system of the types known in the art, for example an "x-y stage."

Following one ejection it may be desired to eject from the same reservoir to another position on the target 142, for example to another well in a well plate to hold an aliquot with which a different test will be carried out or to a different test strip suitable for a different type of test. The target 142 may then be moved automatically under the control of the controller or manually by the user, perhaps with the assistance of markings or stops on the target holder 144. The reservoir may then be retracted or withdrawn somewhat from the enclosed area 146 and lowered again into position. The retraction and lowering could be fully manual, manual but assisted with a suitable mechanism such as a lever arrangement, or automatic. If coupling fluid 150 was withdrawn from the enclosure 146 as the reservoir descended, the coupling fluid would desirably be restored before performing the second ejection.

When ejection has been carried out with one reservoir, it may be desired to repeat the ejection operation with a different reservoir on the same or a different target. For this purpose one would simply remove the reservoir from the enclosed space and repeat the process described above to eject from a new reservoir.

Many different kinds of reservoirs may be used. In one embodiment, for example, sample collection tubes may be used. Tubes of the type called "micro tubes" (e.g., 1.3 mL). It may be desired to use standard tubes or alternatively tubes may be custom manufactured. One goal of custom manufacturing could be, for example, to have flat bottoms. Another goal could be, for example, to avoid imperfections or non-uniformities at the center or the bottom from the gate where the plastics entered the mold in which the tube was formed. For example, in one embodiment avoiding imperfections involves using micro tubes that do not have bubbles or voids formed in the bottom of tubes. In one embodiment, micro tubes would desirably have flat bottoms with no imperfections, like gates, from the molding process.

The acoustic focusing system 152 may have a fixed or variable focal distance. Focusing systems with a fixed focal distance, such as spherical acoustic lenses, are preferred when low cost is an objective. In contrast to acoustic ejectors designed for moving smaller volumes, there may be advantages in having a relatively high focal distance, for example an ejector that results in a lens with a high F-number, for example an F-number of 4.

The volumes of droplets expected to be ejected with the inventive methods may lie between about 2.5 nL to 5 μL, or between 100 nL and 1 μL. The frequencies used to eject may be expected to lie between about 1 and 15 MHz. The ejection may be carried out, for example, with linear chirp waveforms.

When ejection operations are being carried out, the reservoirs and/or targets may be marked with machine readable quantities, such as bar codes. The controller may read these markings using an appropriate sensor and, for example, cause them to be entered into a database or other record the identity of the reservoir from which the fluid in a particular well of a particular well plate was obtained. Alternatively the fact that fluid was ejected from a particular reservoir to a particular target may be recorded, for example, by typing at a console or using a separate bar code reader.

The controller 148 may comprise a computer or similar microprocessor based system which executes software or firmware, possibly assisted by one or more microprocessors designed specifically to perform algorithms of digital signal processing (DSP) or having particular advantages for the performance of such algorithms. Such a controller may also comprise communications hardware, for example a network interface, and corresponding software, to communicate with other laboratory automation equipment and general purpose computers. The controller may also comprise one or more screens, such as LCD screens, and one or more input devices, e.g., touch capability in a screen, joystick, keyboard, or the like. It will also be understood that certain acoustic ejection systems may possess or be connected to automated handling equipment which may, for example, transport reservoirs or targets.

In one embodiment, the controller 148 sends out the ejection pulse during a period of time in which the focal point of the ejector is approximately at a free surface of the fluid in the reservoir (for example, within about 1 mm of the surface, within about 2 mm of the surface, or within about 3 mm of the surface). In one embodiment, the ejection pulse is sent out during a period of time in which the focal point of the ejector is within a small multiple of the wavelength of the acoustic ejection pulse in distance from the free surface of the fluid in the reservoir. The focal point rises relative to the fluid surface as the positions of the reservoir 140 and transducer 154 change relative to one another. Computations to determine the waveform of the ejection pulse are carried out before the end of that period of time. To the extent these computations are based on analysis of the echoes from the interrogation pulse or pulses, the analysis is completed by a particular time.

In the event there is insufficient time to complete computations to determine the ejection pulse waveform, there are other ways to complete the ejection process. In one embodiment, the controller 148 can request that the process of placing the reservoir in the system be repeated. This may be carried out by manually or by an automated system connected to the controller. In one embodiment, the system is equipped to slow the approach of the reservoir 140 towards the transducer 154, by slowing the motion of the reservoir, the transducer, or both. For example, the flow restrictor may be used to slow the reservoir and/or the transducer. Or, in a system with coupling fluid flowing upwards to the reservoir, increasing the flow rate can be used to slow the reservoir. Slowing the motion provides the controller more time to perform the computation of the ejection waveform.

In one embodiment, the controller 148 is programmed to predict the time at which the focus point relative to the fluid surface would enable droplet ejection. This allows for a system design that has a larger delay between the time of the measurement via interrogation pulses and the time at which the acoustic energy is delivered via an ejection pulse. The focal point may move relative to the fluid surface during the delay period between data collection and initiation of the ejection pulse. In some cases, movement may be significant relative to distance range over which effective droplet formation can be achieved.

To account for this movement, one embodiment includes the ability to predict the time at when the focal point position would be optimal for ejection, and schedule the ejection of droplets accordingly with the controller 148. The time prediction for droplet ejection may be based on several factors. The time prediction may be based on the tolerance of the optimal focal point position. The time prediction may also be based on the projected velocity of the fluid surface relative to the transducer 154 location, The velocity may be calculated using historical time and position measurements. The time prediction may use other reference points instead of the fluid surface and transducer location. For example, any part of the reservoir may be used as a substitute for the fluid surface position. In another example, any part of the system fixed to the transducer may be used as substitute for the transducer. The focal point position may also be used in place of the transducer position. The time prediction may also be based on latency due to processing, triggering, acoustic propagation, and the like. The time prediction uses an estimate of the velocity of approach of the transducer relative to the fluid surface in the reservoir based on the interrogation pulse measurements. The time prediction incorporates assumptions about the uncontrolled motion of the reservoir as it moves through the coupling fluid towards the transducer.

In one alternative, a single computer program running always on a microprocessor in the controller 148 directs all operations. The program polls the relevant I/O ports of the controller rather than operating in an interrupt-driven fashion. The program executes an algorithm like those described with respect to FIGS. 2A-2C, below. This polling approach may be employed advantageously, for example, when the system is designed for one reservoir.

Alternatively, and more conveniently, the controller may be programmed in a multitasking manner using interrupts. A variety of textbooks, for example, address the problem of meeting hard external time constraints in a multitasking and interrupt driven software configuration, which is commonly referred to as "real time computing."

As one possible technique for dealing with the real time demand of the described methods it would be possible to employ an operating system suitable for real time processing, such as QNX from QNX Software Systems (Ottawa, Ontario, Canada). One could, for example, have a single thread or process which has a high priority to handle the most important tasks and in particular the computations with the interrogation pulse data to determine the waveform (including the energy) used for ejection. Alternatively, however, a non-real-time operating system such as Microsoft Windows XP may be employed. With such an operating system, it may be helpful to remove nonessential components and to take other steps to avoid long delays in code execution, e.g., use of a solid state memory in lieu of a disk drive.

It may be desirable, regardless of operating system, to have a custom scheduler within the controller which determines an order in which tasks should be executed in order to meet the time constraints. The custom scheduler would have some knowledge of the time which each step in the overall algorithm takes and would use operating system facilities to cause the tasks to be executed in the desired order. In this scheduler or otherwise, it may be desirable to give highest priority to analyzing the results of the Power Test. In the multiejector case, it would make sense to prioritize the ejector which has the least amount of z-direction travel left before it is in ejection position.

In the implementation of the algorithms, it may be desirable to make use of whatever vector facilities a microprocessor in the controller possesses, for example the Streaming SIMD Extensions (SSE) of the Intel x86 series of microprocessors. Libraries are available to facilitate the use of these vector facilities. In addition, it may be desirable to consider in the implementation the peculiarities of multiple execution in the particular microprocessor being used in the controller, as discussed from example in Kris Kaspersky, *Code Optimization: Effective Memory Usage* (A-List LLC, 2003). In addition, it may be possible to employ multiple microprocessors or multicore microprocessors to obtain additional processing power for the performance of these computations. For example, in an embodiment with many ejectors, it could be desirable to provide a microprocessor for each of a small set of ejectors, for example for each four or eight or sixteen ejectors.

In one embodiment, example algorithms which may be used for fluid property determination could be, for example, those described in U.S. Pat. Nos. 7,354,141 and 7,454,958, commonly assigned with the present application. For the determination of the waveform and energy used for ejection, the algorithms described in U.S. Patent Application No. 2006/0071983, also commonly assigned, may be employed. International patent application WO/2006/039700 also provides information regarding fluid property determination and ejection.

Figure 4:
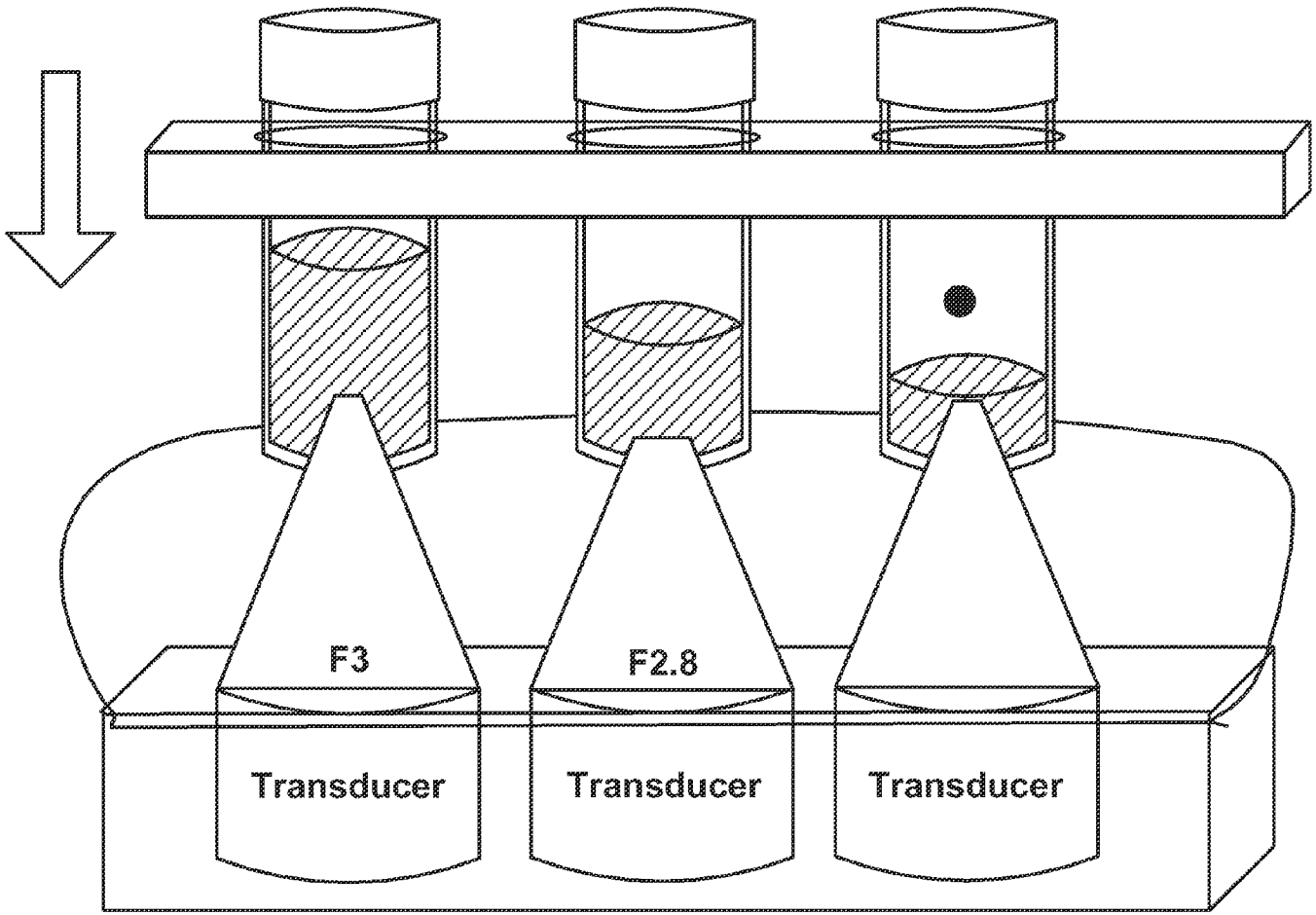
FIG. 4 schematically depicts an example setup for focus-activated acoustic ejection, according to one embodiment.

FIG. 4 schematically depicts an example setup for focus-activated acoustic ejection, according to one embodiment. In the example embodiment of FIG. 4, there is an array of ejectors under the control of a controller. The example embodiment of FIG. 4 shows a one dimensional line array of ejectors. In another example embodiment, the array of ejectors may include a two dimensional array of ejectors which may, for example, be aligned to match up with a 96 well target device. Above the array of ejectors is a coupling fluid. A set of reservoirs descend slowly into the coupling fluid. Above the set of reservoirs is a target such as a well plate held in place by a target holder, possibly accompanied by a suitable mechanism for positioning the target horizontally. The descending reservoirs may be, for example, sample tubes in a suitable holder. The ejectors send interrogation pulses into the reservoirs above them and determine properties of the fluids in those reservoirs. Based on these measured properties, each ejector sends an ejection pulse to its respective reservoir at a time when the free surface of the fluid in the reservoir is at an appropriate position for ejection.

In the example embodiment of FIG. 4, the lenses of the acoustic focusing system may not have the same f-number. Thus, even if two reservoirs had the same fluid, fluid heights and gap between their bottom surfaces and the ejectors, they would not necessarily come into focus at the same time. Similarly, transducers may be identical in f-number and fluid height, however the fluid impedance of the two reservoirs may not match. While the lenses would have the same f-number in the coupling medium, they would have different f-numbers in the fluid of each reservoir. As a result, each reservoir/acoustic ejector pair would have a different optimal position (and therefore time) for ejection.

In the arrangement just described, it may be that there is one ejector per reservoir. Alternatively, each ejector may be provided with a mechanism to move it about so that it can service a set of adjacent reservoirs, for example four. In this example, the entire array of ejectors could be moved as required a short distance in the x and/or y direction. In a typical use of this example arrangement, the ejector is moved so that it is successively placed below the four reservoirs which it is servicing, and is then moved between those four reservoirs in order to provide the ejection pulse.

In the arrangement described immediately above, the order of ejection from different reservoirs will generally be in rough order of the z axis distance of the top of the fluid in the reservoirs from the corresponding acoustic ejector. This may result in the appearance that drops are being ejected from the reservoirs in a seemingly random order. This seemingly random ejection order differs from the order disclosed in U.S. Pat. No. 6,666,541, in which the ejector moving about a collection of reservoirs is programmed to proceed in a systematic order from one reservoir to an adjacent one.

Time prediction of when to eject a droplet may be extended from the single transducer and/or single controller case to the multiple controller and/or multiple transducer case as well. In some embodiments, having measurements of position from multiple reservoirs with time stamps may provide velocity. This is a potential alternative to relying on historical time and position measurements of a single reservoir. Additionally, in some embodiments, the controller may have stored values for velocities associated each type of reservoir or historical measurements for each type of reservoir that could augment velocity estimation.

Embodiments which handle pathogenic materials may desirably comprise pathogen-safe enclosures. The entire system described above in connection with FIG. 1 may, for example, be placed within a commercially available biosafety cabinet. Alternatively, special purpose enclosures may be designed for example to encompass closely the elements shown in FIG. 1, or to have a special purpose lock system to place pathogenic samples and/or targets inside the enclosure for ejection and remove them subsequently. Where pathogenic materials are being handled a system for uncapping and recapping the reservoirs within the pathogenic enclosure can be of particular value. For further discussion of precautions for handling pathogenic materials, please refer to U.S. Pat. No. 7,405,072, commonly assigned with the present application.

EXAMPLE METHODS

Figure 2A:
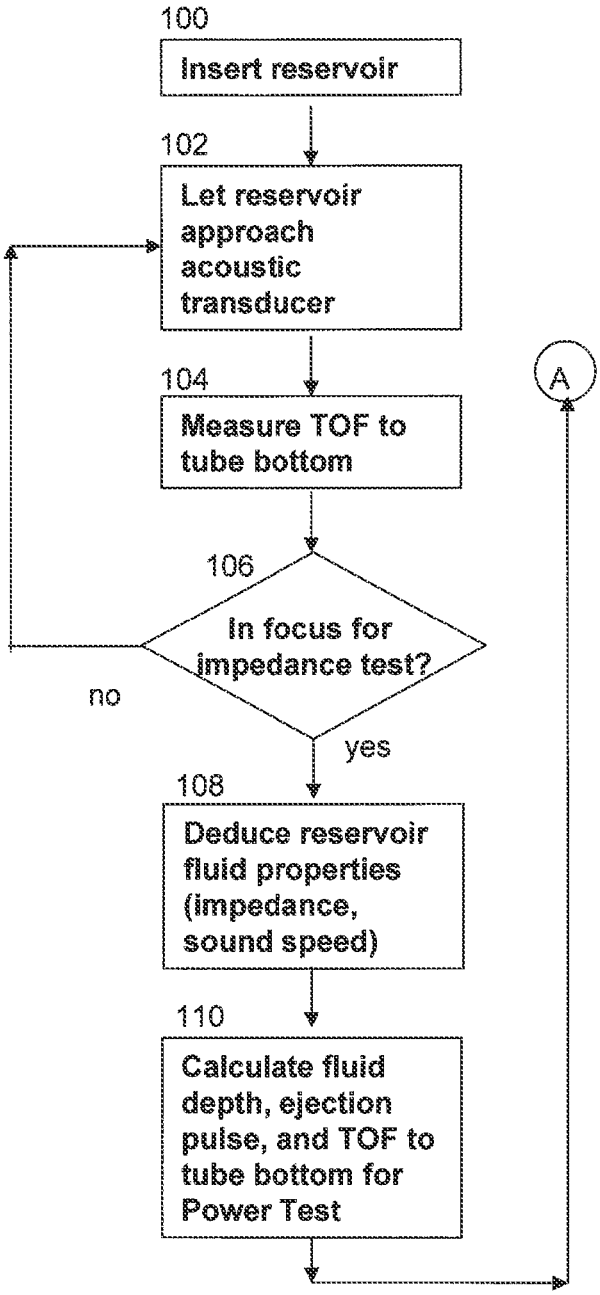
FIGS. 2A-2C are a flowchart of a method of focus-activated acoustic ejection, according to one embodiment.
Figure 2B:
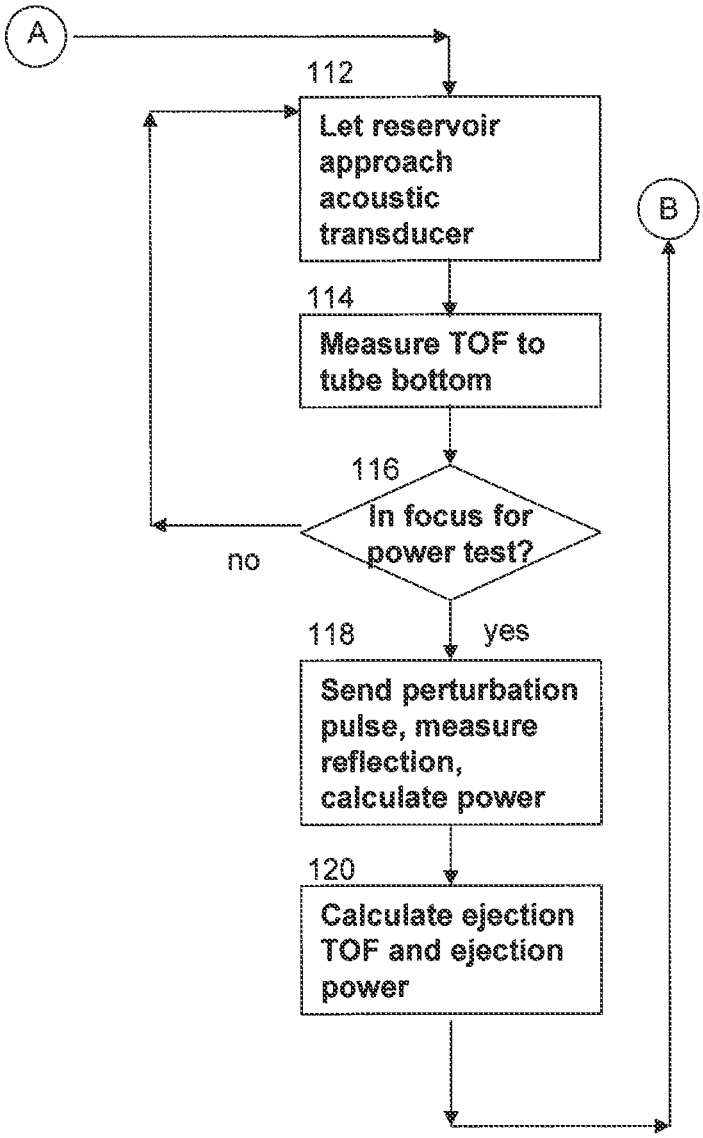
Figure 2C:
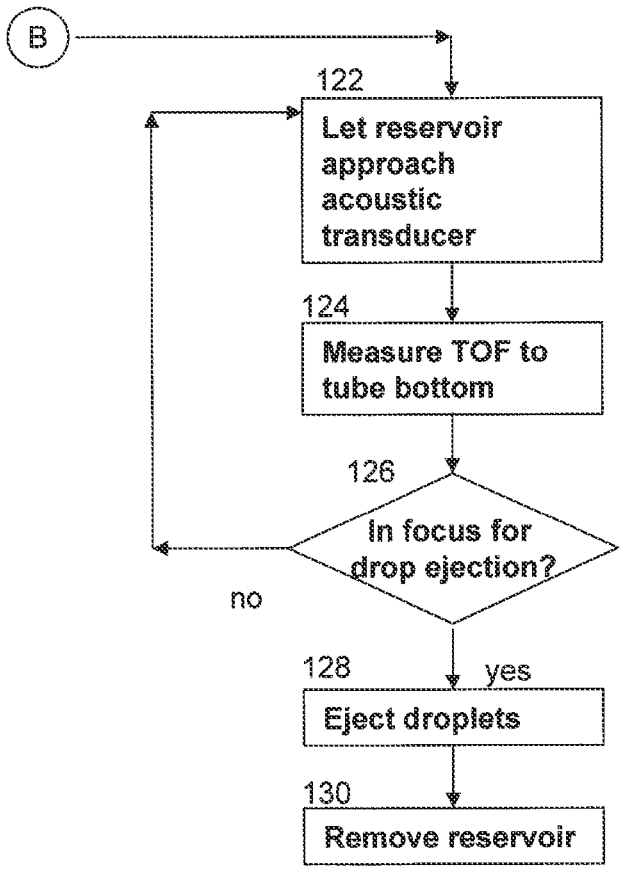

FIGS. 2A-2C are a flowchart of a method of focus-activated acoustic ejection, according to one embodiment. As may be seen from the figure, a reservoir is inserted 100. The reservoir is permitted or made to approach the acoustic transducer 102. An interrogation pulse is sent in order to measure the time of flight (TOF) to the bottom of the reservoir 104. Based on the interrogation pulse echo, it is determined whether the reservoir is sufficiently close to the acoustic transducer for the determination of fluid properties such as acoustic impedance 106. Preferably, when the reservoir is in this position, the focal point is slightly above the top of the bottom of the reservoir, for example such that the top of the bottom is no more than about 0.8, no more than about 0.9, no more than about 0.95, no more than about 0.96, no more than about 0.97, no more than about 0.98, or no more than about 0.99 of the distance from the focusing system to the focal point. If the focal point is not at in a desired distance range, another interrogation pulse is set out for TOF determination 104. If the focal point is within an acceptable distance range, however, reservoir fluid properties such as impedance and speed of sound are deduced from the echo from the interrogation pulse, possibly with the aid of further pulses 108. In addition, a fluid depth, ejection pulse, and TOF are calculated for the so-called "Power Test," whose primary purpose is to determine power needed to eject 110.

Following the Power Test 110, there is a further approach of the reservoir towards the ejector 112 and a further interrogation pulse for TOF determination of reservoir position and fluid surface position in the reservoir is sent 114. When the reservoir is close enough for a second "Power Test" 116, then a perturbation pulse and possibly one or more further interrogation pulses are sent 118. The ejection TOF, ejection power, and possibly other ejection parameters are calculated 120. There is then a further approach of the reservoir towards the ejector 122, and further interrogation pulses to test TOF 124. Finally, when the distance between fluid free surface and ejection is adequate to eject 126, the ejection pulse is sent out in order to cause ejection 128.

The term "perturbation pulse" used in the preceding paragraph is explained in U.S. Patent Application No. 2006/0071983. The purpose of the pulse is to cause a perturbation in the fluid surface which is subsequently analyzed by means of at least one interrogation pulse.

Figure 3A:
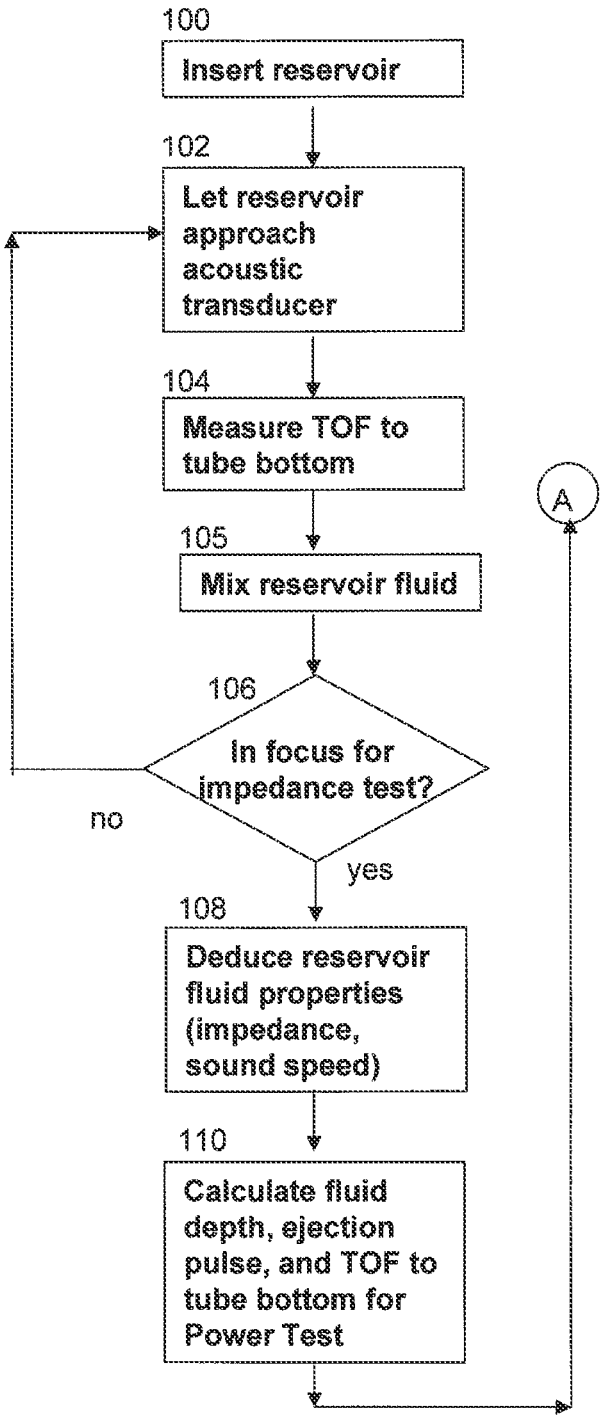
FIGS. 3A-3B are a flowchart of a method of focus-activated acoustic ejection, according to another embodiment.
Figure 3B:
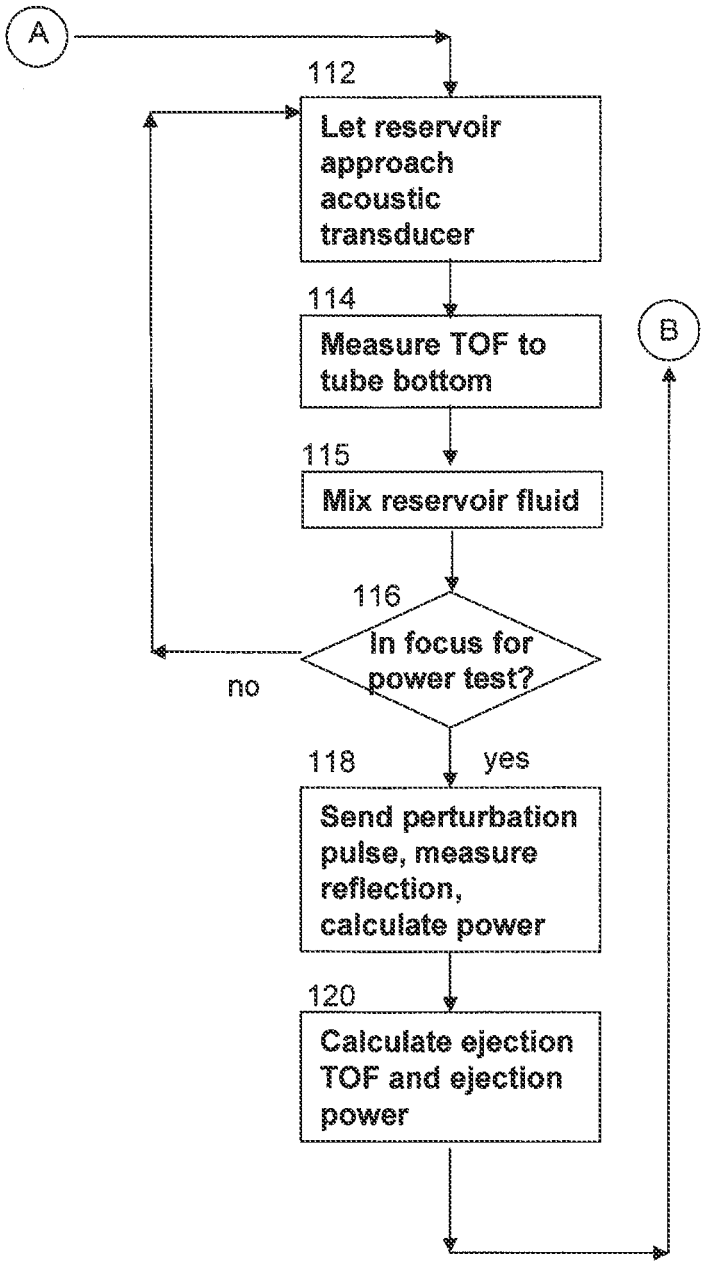

FIGS. 3A-3B are a flowchart of a method of focus-activated acoustic ejection, according to another embodiment. The algorithm depicted in FIGS. 2A-2C may be modified by mixing (105 and 115) the contents of the reservoir, as shown in FIGS. 3A-3B. The mixing may be accomplished, for example, by appropriate use of ultrasonic energy. When the flowchart of FIGS. 3A-3B reaches to connector B, the algorithm would continue as in FIG. 2C.

Mixing is particularly desired in situations where the biological samples to be moved comprise cells. For blood samples where cells have settled to the bottom of the reservoir, the acoustic ejector could apply acoustic energy in order to get the cells moving and into the bulk fluid. Optionally, some relative motion of the acoustic beam with respect to the reservoir could be used to improve mixing. Such motion might include, for example, the sweep of the beam upward in the fluid as the reservoir approaches the acoustic lens or some lateral relative motion that gets the focus of the beam away from the central axis of the reservoir. This might be beneficial in imparting momentum to the cells that have settled along the outer edge of the reservoir.

For the experimental determination of the appropriate energy content of an ejection waveform in accordance with U.S. Published Patent Application No. 2006/0071983 the following is performed: A scaled-back waveform from past data with a relatively low energy level which would not be sufficient to eject a droplet is obtained. The ejector is directed to generate the scaled back waveform and send it to a focus somewhat below the top surface of the fluid. Some time thereafter, for example a few hundred microseconds, an interrogation pulse is sent to the fluid surface. In one embodiment, the interrogation pulse is brief, for example, one or two cycles, preferably at the transducer center frequency. Likewise, the interrogation pulse preferably has sufficiently low power so as not to significantly further perturb the fluid surface.

The echo from the interrogation pulse would optionally be isolated by filtering or otherwise from other inputs sensed by the transceiver. The echo is subjected to a Fourier-type transform algorithm such as a Fast Fourier Transform (FFT). A Fourier-type transform algorithm includes, for example, any algorithm which reaches a result which can be calculated by a technique which performs or approximates a discrete or continuous convolution of the sample data with a complex exponential function of a discrete or continuous variable. Such algorithms may include, for example, the Discrete Fourier Transform (DFT).

It has been determined empirically, as discussed in U.S. Published Patent Application No. 2006/0071983, that there is a relationship $E_T = A \times \ln(\text{min_spacing}) + B$ where $E_T$ is difference between the energy of the scaled back waveform and the energy needed for ejection, while min_spacing is the difference in MHz (or some other convenient unit of frequency) between two minima of the FFT-transformed echo waveform. The values A and B vary somewhat with the fluid. Exemplary values of A and B measured for a mixture of 70% DMSO and 30% water would be 0.44 and 0.49, giving an $E_T$ in decibels where min_spacing is expressed in MHz.

In the operation of the algorithms for acoustic ejection (e.g., 118 of FIG. 2B), min_spacing may be calculated and thus the energy appropriate for achieving ejection may determined. In certain cases, the determination of min_spacing may be unreliable due to the lack of two clearly defined minima, or the distance between two minima being too large. The presence or absence of minima or the distance being too large is a measure of the quality of the energy determination using the method described in U.S. Published Patent Application No. 2006/007198. In that case, it may be desirable to send out a more energetic perturbation pulse and repeat the determination. In addition, the TOF may be used to determine the height of the perturbation pulse directly. If that height is considerably less than expected, it may be desirable to send out a more energetic perturbation pulse and repeat the determination.

The calculation of the initial perturbation pulse energy may be assisted by knowledge of the surface tension of the liquid in the reservoir because surface tension affects the amount of perturbation achieved for a given energy. The energy of the perturbation pulse can then be based on the ejection energies required for fluids of similar surface tension and viscosity. However, if the perturbation pulse energy is determined without this knowledge of surface tension, an iterative determination of the energy as indicated in the preceding paragraph can compensate for this lack of knowledge at the cost of possibly starting with an overly low energy and possibly having to make two or more tries at higher energies.

There are a number of uses for the systems and methods described above in the handling of biological samples. Many patient samples containing cells are used to seed cell cultures and are employed to determine the presence of pathogenic material such as bacteria and viruses. For example, containers having an interior surface coated with a layer of solid or semisolid medium within which cells are grown may be inoculated with the desired type of cells. After the cells are subjected to conditions appropriate for cultivation, they may be removed from the containers as a suspension and may optionally be concentrated. Also, if desired, viral matter may be extracted from the cells after removal from the containers.

Additional Considerations

It is to be understood that this description is not limited to specific solvents, materials, or device structures, as such may vary. It is also to be understood that the terminology used herein is for the purpose of describing particular embodiments only, and is not intended to be limiting.

As used in this specification and the appended claims, the singular forms "a," "an," and "the" include both singular and plural referents unless the context clearly dictates otherwise. Thus, for example, reference to "a fluid" includes a plurality of fluids as well as a single fluid, reference to "a temperature" includes a plurality of temperatures as well as single temperature, and the like.

For information regarding words which have multiple meanings, reference is made to *The Oxford English Dictionary* (2d ed. 1989), the *McGraw-Hill Dictionary of Scientific and Technical Terms* (6th ed. 2002) and to *Hawley's Condensed Chemical Dictionary* (15th ed. 2007), which are incorporated by reference herein. The inclusion of these references is not intended to imply that every definition in them is necessarily applicable here, as persons of skill in the art would often see that a particular definition is not in fact applicable in the present context.

Where a range of values is provided, it is intended that each intervening value between the upper and lower limit of that range and any other stated or intervening value in that stated range is encompassed within the disclosure. For example, if a range of 1 μm to 8 μm is stated, it is intended that 2 μm, 3 μm, 4 μm, 5 μm, 6 μm, and 7 μm are also disclosed, as well as the range of values greater than or equal to 1 μm and the range of values less than or equal to 8 μm.

In this application reference is sometimes made to "horizontal" or "vertical" in terms of the standard acoustic ejection configuration in which a fluid is in a reservoir and has a free surface which is approximately horizontal, i.e., perpendicular to the direction of the earth's gravity. However, it is also possible for a fluid to be retained in a reservoir and have a free surface not approximately horizontal, e.g., a fluid retained in the reservoir by surface forces including its own surface tension despite the reservoir being sideways or upside-down.

The term "pulse" is used synonymously with toneburst. Among those of skill in the art, a toneburst tends to connote a longer burst of acoustic energy, while a pulse tends to connote a shorter burst. Because there is no firm boundary between the two terms, the two terms are treated as synonymous for purposes of this application.

All patents, patent applications, and publications mentioned herein are hereby incorporated by reference in their entireties. However, where a patent, patent application, or publication containing express definitions is incorporated by reference, those express definitions should be understood to apply to the incorporated patent, patent application, or publication in which they are found, and not to the remainder of the text of this application, in particular the claims of this application.

What is claimed is:

1. A method of ejecting a fluid droplet from a fluid reservoir, the method comprising:

moving at least one of the fluid reservoir and an acoustic ejector with respect to each other so that a focal point position of the acoustic ejector changes with respect to a fluid surface within the fluid reservoir;

while at least one of the reservoir or acoustic ejector is still moving:

sending an interrogation pulse from the acoustic ejector toward the fluid surface of the reservoir;

measuring an input echo corresponding to the interrogation pulse;

estimating a relative velocity of approach between the focal point position and the fluid surface based on the interrogation pulse and input echo;

predicting a time for droplet ejection based on the relative velocity of approach; and, sending an ejection pulse from the acoustic ejector to eject the fluid droplet from the fluid reservoir at the predicted time.

2. The method of claim 1 wherein predicting a time for droplet ejection further comprises determining a property of the fluid in the reservoir based on the interrogation pulse and the input echo.

3. The method of claim 2, wherein the property is acoustic impedance.

4. The method of claim 1, wherein predicting a time for droplet ejection further comprises determining an energy level suitable for ejecting the droplet from the reservoir.

5. The method of claim 4, further comprising repeating determining the energy level if a measure of the reliability of the energy level is too low.

6. The method of claim 4 further comprising determining a location of two minima in a Fourier transform of the input echo received from the interrogation pulse.

7. The method of claim 1, repeated for a plurality of reservoirs which each move simultaneously with respect to a plurality of corresponding acoustic ejectors.

8. The method of claim 7, wherein an ejection pulse is sent towards each of the plurality of reservoirs, and a fluid droplet is ejected from each of the plurality of reservoirs.

9. The method of claim 1, wherein the acoustic ejector comprises a focusing system which produces acoustic energy having a fixed focal length when immersed in a quantity of fluid with a height which is at least the fixed focal length.

10. The method of claim 1, wherein the movement of the reservoir with respect to the acoustic ejector is achieved by the force of gravity.

11. The method of claim 1, wherein moving at least one of the fluid reservoir and an acoustic ejector with respect to each other is achieved by withdrawal of a coupling medium.

12. The method of claim 11, wherein withdrawal of the coupling medium is based on the interrogation and the input echo.

13. The method of claim 1, further comprising removing and replacing a cap on the reservoir.

14. The method of claim 1, further comprising positioning a target to receive the ejected fluid droplet.

15. The method of claim 13, further comprising reading a barcode located on the reservoir and/or on the target.

16. The method of claim 1, further comprising determining the position of the bottom of the reservoir relative to the acoustic ejector based on the input echo and the interrogation pulse.

17. The method of claim 1, wherein moving at least one of the fluid reservoir and the acoustic ejector with respect to each other additionally comprises maintaining the acoustic ejector in a fixed position.

18. The method of claim 1, wherein moving at least one of the fluid reservoir and the acoustic ejector with respect to each other comprises decreasing a distance between the fluid reservoir and the acoustic ejector monotonically as a function of time.

19. The method of claim 1, wherein moving at least one of the fluid reservoir and the acoustic ejector with respect to each other is achieved by moving the acoustic ejector towards the fluid reservoir.

20. The method of claim 1, wherein moving at least one of the fluid reservoir and the acoustic ejector with respect to each other is achieved by moving the fluid reservoir towards the acoustic ejector.

21. The method of claim 1, wherein predicting the time for droplet ejection is further based on at least one from the group consisting of:

a tolerance of the focal point position, a tolerance of the estimated relative velocity, one or more historical time and position measurements of a part of the fluid reservoir, a processing latency, a triggering latency, and an acoustic propagation latency.

22. A system for ejecting a fluid droplet from a fluid reservoir comprising:

the fluid reservoir;

an acoustic ejector, capable of being moved with respect to the fluid reservoir so that a focal point position of the acoustic ejector changes with respect to a fluid surface within the fluid reservoir, the acoustic ejector configured to send an interrogation pulse and an ejection pulse towards the fluid surface of the reservoir while at least one of the reservoir or acoustic ejector is moving, the acoustic ejector configured to eject the fluid droplet from the fluid reservoir at a predicted time; and a controller coupled to the acoustic ejector, the controller configured to determine the interrogation and ejection pulses sent by the acoustic ejector, and predict the predicted time for droplet ejection based on an estimate of a relative velocity of approach between the focal point position and the fluid surface, the estimate of the relative velocity based on measurement of an input echo corresponding to the interrogation pulse.

23. The system of claim 22, enclosed in a pathogen-impermeable enclosure.

24. The system of claim 22, wherein the system comprises a regulated flow restrictor for controlling the motion of at least one of the reservoir and the acoustic ejector.

25. A system for ejecting a fluid droplet from a fluid reservoir comprising:

an acoustic ejector capable of being moved with respect to the fluid reservoir so that a focal point position of the acoustic ejector changes with respect to a fluid surface within the fluid reservoir, the acoustic ejector configured to send a plurality of interrogation pulses and an ejection pulse towards the fluid surface of the reservoir while at least one of the reservoir or acoustic ejector is moving, the acoustic ejector configured to eject the fluid droplet from the fluid reservoir responsive to a fluid reservoir position being sufficiently close to a predicted position for droplet ejection;

a controller coupled to the acoustic ejector, the controller configured to determine the interrogation and ejection pulses sent by the acoustic ejectors, and predict the predicted position for droplet ejection based on an estimate of a relative velocity of approach between the focal point position and the fluid surface, the estimate of the relative velocity based on measurement of an input echo corresponding to one of the interrogation pulses, determine a plurality of positions of a plurality of the fluid surface of the fluid reservoir, the positions determined based on one or more of the interrogation pulses and based on one or more corresponding input echoes received by the acoustic ejector; and a mechanism for controlling the motion of either the fluid reservoir or the acoustic ejector.

26. A method of ejecting a droplet from a fluid reservoir, the method comprising:

moving at least one of the fluid reservoir and an acoustic ejector with respect to each other so that a focal point position of the acoustic ejector changes with respect to a fluid surface within the fluid reservoir;

while at least one of the reservoir or the acoustic ejector is still moving:

sending an interrogation pulse from the acoustic ejector toward the fluid surface of the reservoir;

measuring an input echo corresponding to the interrogation pulse;

estimating a relative velocity of approach between the focal point position and the fluid surface based on the interrogation pulse and input echo;

predicting a position for droplet ejection based on the relative velocity of approach;

sending one or more additional interrogation pulses from the acoustic ejector;

measuring one or more additional input echoes corresponding to the one or more additional interrogation pulses;

determining one or more fluid reservoir positions based on the one or more additional input echoes;

ejecting a fluid droplet from the fluid reservoir responsive to the fluid reservoir position being sufficiently close to the predicted position for droplet ejection.

* * * * *